US009290958B2

(12) United States Patent
Lopez

(10) Patent No.: US 9,290,958 B2
(45) Date of Patent: Mar. 22, 2016

(54) SWIMMING POOL CLEANER APPENDAGES

(71) Applicant: Thomas V. Lopez, Phoenix, AZ (US)

(72) Inventor: Thomas V. Lopez, Phoenix, AZ (US)

( * ) Notice: Subject to any disclaimer, the term of this patent is extended or adjusted under 35 U.S.C. 154(b) by 471 days.

(21) Appl. No.: 13/652,331

(22) Filed: Oct. 15, 2012

(65) Prior Publication Data

US 2014/0101870 A1 Apr. 17, 2014

(51) Int. Cl.
*E04H 4/16* (2006.01)

(52) U.S. Cl.
CPC ..... *E04H 4/1654* (2013.01); *E04H 4/16* (2013.01)

(58) Field of Classification Search
CPC ..... E04H 4/16; B62D 57/02
USPC ..... 15/1.7
See application file for complete search history.

(56) References Cited

U.S. PATENT DOCUMENTS 2,988,762 A 6/1961 Babcock
3,917,171 A * 11/1975 Reinke ..... 239/728
4,227,608 A * 10/1980 Alfthan et al. ..... 198/630
5,255,753 A * 10/1993 Nishikawa et al. ..... 180/8.6
5,404,607 A 4/1995 Sebor
5,797,156 A 8/1998 Sebor
6,112,354 A 9/2000 Stoltz et al.
6,365,039 B1 4/2002 Henkin et al.
6,971,136 B2 12/2005 Horvath et al.
7,316,751 B2 1/2008 Horvath et al.
D630,808 S 1/2011 Dye et al.
D630,809 S 1/2011 Dye et al.
8,312,583 B2 * 11/2012 van der Meijden et al. ..... 15/1.7
2002/0166185 A1 11/2002 Balint
2005/0273950 A1 12/2005 Stehelin
2006/0065580 A1 3/2006 Henkin et al.
2006/0249314 A1 * 11/2006 Takenaka et al. ..... 180/8.1
2007/0062733 A1 3/2007 Henkin et al.
2010/0313363 A1 * 12/2010 Moore et al. ..... 15/1.7

* cited by examiner

*Primary Examiner* — Randall Chin
(74) *Attorney, Agent, or Firm* — Thomas W. Galvani, P.C.; Thomas W. Galvani

(57) ABSTRACT

A pool cleaner for cleaning a pool surface includes a chassis, arms mounted to the chassis for oscillatory movement in response to water being drawn through the pool cleaner and rotating a drive assembly operatively coupled to the arms, a wing mounted to each of the arms for flapping movement in response to the oscillatory movement of the arms, and projections carried on an underside of the wings for disturbing material from the pool surface to be cleaned by the pool cleaner.

14 Claims, 7 Drawing Sheets

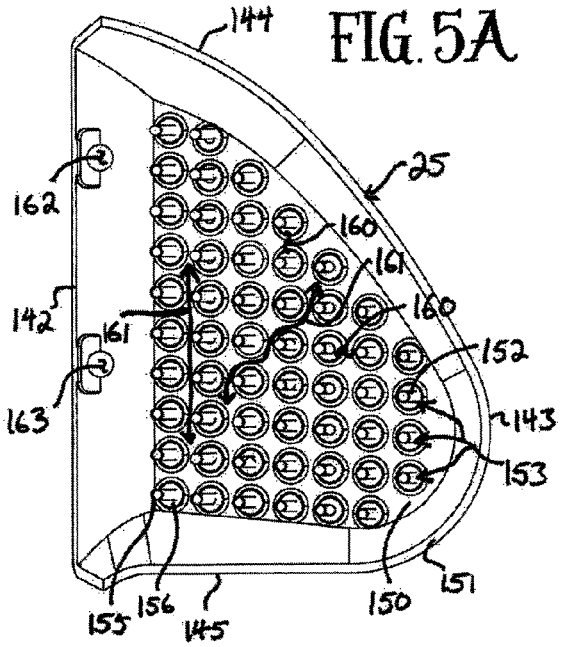
FIG. 5A
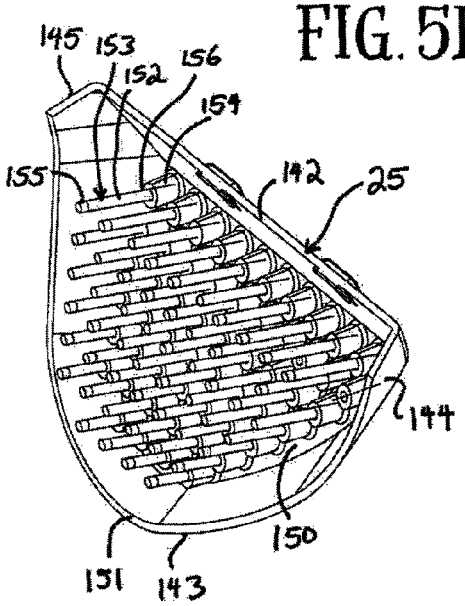
FIG. 5B
FIG. 5C
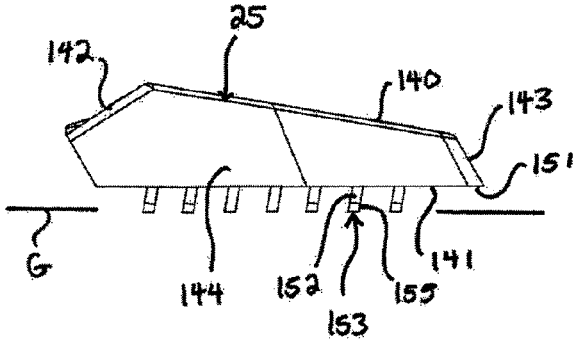
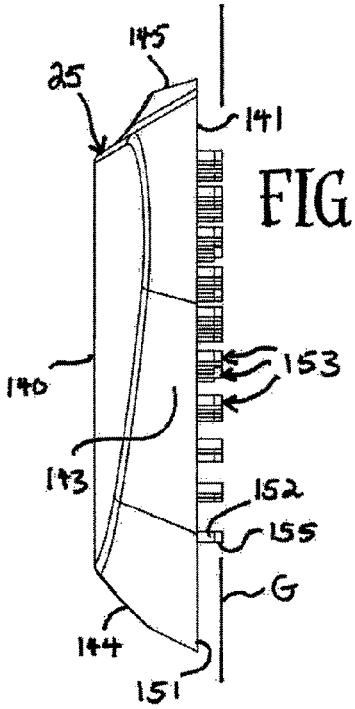
FIG. 5D

SWIMMING POOL CLEANER APPENDAGES

FIELD OF THE INVENTION

The present invention relates generally to swimming pool cleaners, and more particularly to appendages for pool cleaners.

BACKGROUND OF THE INVENTION

Swimming pools must be maintained to be useful. Properly maintaining a pool can require a great deal of work on the part of the pool owner, including treating the pool water with multiple chemicals, skimming the pool water surface, sweeping the pool floors and sidewalls, and vacuuming the pool surfaces. Different pool surfaces, such as vinyl, portland cement plaster, and exposed aggregate pebble or shotcrete present their own special difficulties. Automated pool cleaner vacuum systems have been developed to ease some of the workload involved in keeping a pool clean.

Automated pool cleaners typically use the power of the pool pump to move through the water across the pool surface. Most pool cleaners include a hose that stretches from the pool pump to the pool cleaner, and are propelled by the vacuum force created by the pool pump drawing water through the hose and pool cleaner. All of these pool cleaners have at least one part that is a point of contact on the pool surface. In pools with smooth or textured concrete surfaces, these points of contact can wear down very quickly, requiring further attention and maintenance from the owner who has to replace the part. Additionally, the performance of these parts often degrades with time and wear, causing them to be less effective at cleaning the pool surface or moving across the pool surface. An improved system for maintaining contact and cleaning a pool surface is needed.

SUMMARY OF THE INVENTION

According to the present invention, a pool cleaner includes a housing, arms mounted to the housing for oscillatory movement in response to water being drawn through the pool cleaner and rotating a drive assembly operatively coupled to the arms, shoes mounted to opposed ends of the arms, and a wing mounted to each arm for flapping movement in response to the oscillatory movement of the arms. The shoes are formed with a plurality of projections or nubs which extend through material collected on the pool surface for enhanced traction with the pool surface. The wings have undersides carrying bristles for disturbing material collected on the pool surface as the wings flap, so that the material may be drawn into the pool cleaner.

BRIEF DESCRIPTION OF THE DRAWINGS

Referring to the drawings:

FIGS. 5A-5D are bottom, perspective, front, and side views of one of the wings of FIG. 1;

DETAILED DESCRIPTION

Figure 1:
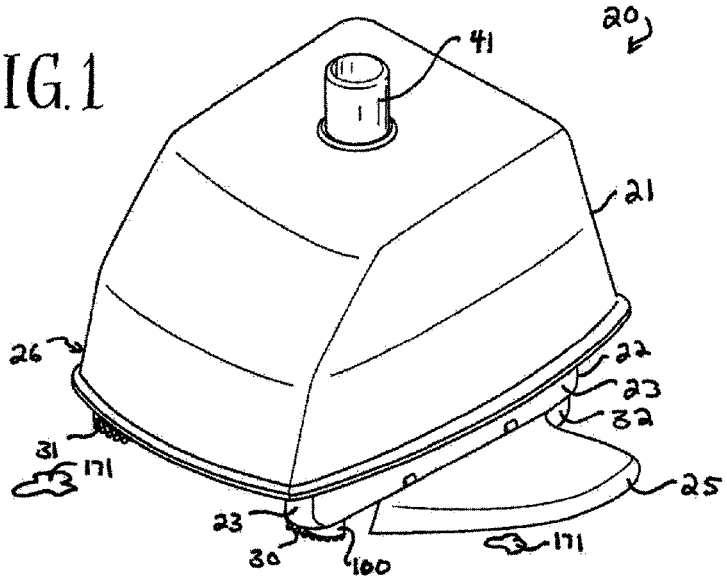
FIG. 1 is a front perspective view of a pool cleaner arranged and constructed according to the principle of the invention, having a housing, a chassis, arms coupled to the chassis for oscillatory movement, wings coupled to the arms for oscillatory movement, and shoes mounted to the arms.
Figure 2:
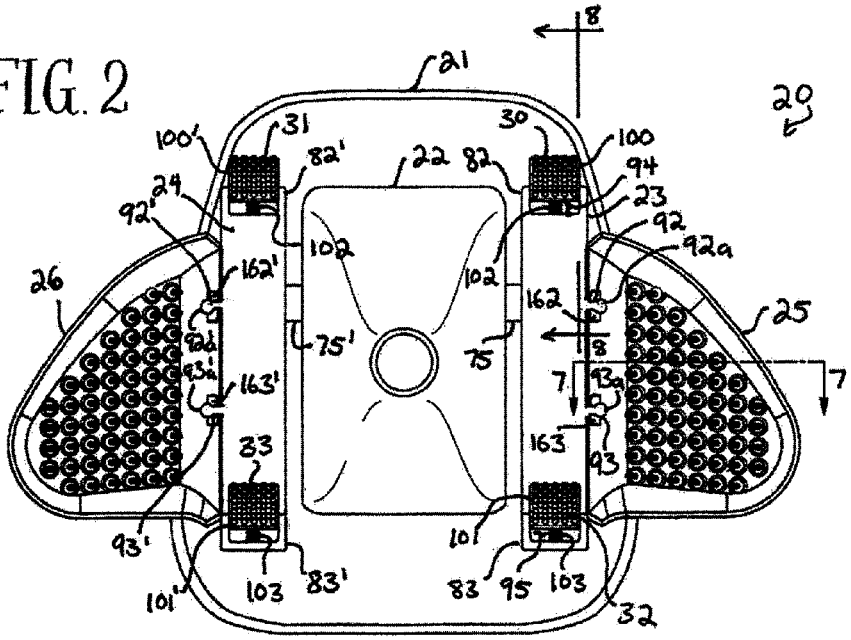
FIG. 2 is a bottom plan view of the pool cleaner of FIG. 1.

Reference now is made to the drawings, in which the same reference numbers are used throughout the different figures to designate the same components. FIG. 1 and FIG. 2 illustrate a self-propelled swimming pool cleaner 20 having a housing 21, a chassis 22 mounted to the housing 21, arms 23 and 24 mounted to the chassis for oscillating movement, wings 25 and 26 mounted to the arms 23 and 24, respectively for flapping movement, and shoes 30, 31, 32, and 33 mounted to the arms 23 and 24. The cleaner 20 is a heavier-than-water apparatus useful for cleaning material 171, such as dirt, sediment, algae, and the like that is collected on a pool surface 34 (not shown) of a swimming pool structure. The housing 21 and chassis 22 of the cleaner 20 in FIG. 1 are exemplary of known cleaners, and it should be understood that the invention is useful with a cleaner 20 having any of several designs, including that as shown in FIG. 1.

Figure 3:
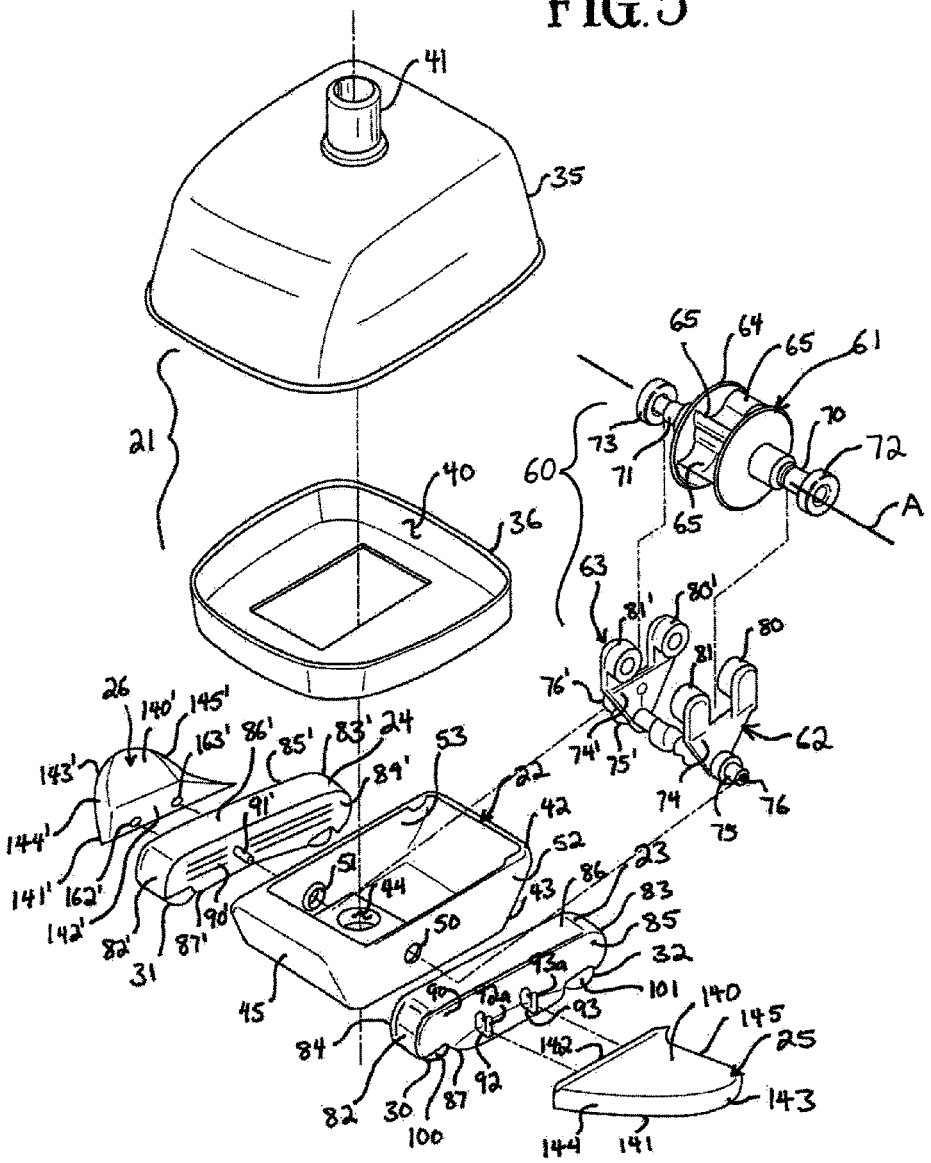
FIG. 3 is an exploded perspective view of the pool cleaner of FIG. 1.

FIG. 3 is an exploded view of the cleaner 20. The housing 21 of the cleaner includes a domed upper portion 35 and a lower frame member 36, which cooperate to bound and define a chamber 40 extending between the upper portion 35 and the frame member 36. A short, upstanding, open-ended tube mounted for rotation to the upper portion 35 is coupled in fluid communication with the chamber 40 and defines an outlet 41 from the chamber 40 at which a hose may be coupled to the cleaner 20 so as to couple the cleaner 20 to the pool pump in fluid communication.

The chassis 22 is mounted to the frame member 36 along an open top 42 of the chassis, and includes an inlet 44 formed in a bottom 43 of the chassis 22. The inlet 44 is a circular bore extending through the bottom 43 of the chassis 22, and is in fluid communication with the chamber 40 through the open top 42 of the chassis 22. The chassis 22 has a sidewall 45 extending between the top 42 and the bottom 43, and includes holes 50 and 51 on opposed sides 52 and 53 of the sidewall 45. The arms 23 and 24 are coupled to the chassis 22 at the holes 50 and 51, respectively, for oscillatory movement to drive the pool cleaner 20.

Still referring to FIG. 3, a drive assembly 60 is carried within the pool cleaner 20 to drive the arms 23 and 24 so as to move the pool cleaner 20 across the pool surface 34 (not shown). The drive assembly 60 includes an impeller 61 and two opposed yokes 62 and 63 coupled between the impeller 61 and the arms 23 and 24 to oscillate the arms 23 and 24 in response to rotation of the impeller 61. The impeller 61 includes a central body 64 aligned on an axis A, the body 64 formed with vanes 65 extending radially outward from the axis A. Opposed first and second axles 70 and 71 extend axially outward from the body 64 and terminate in distal hubs 72 and 73, respectively. The hubs 72 and 73 are offset from axis A, so that the hubs 72 and 73 are not coaxial with the impeller 61. The hubs 72 and 73 are seated on and carried in the yokes 62 and 63, respectively. The yokes 62 and 63 are identical, and as such, reference will be made to only the yoke 62 with the understanding that the discussion applies equally to the yoke 63, and the features of the yoke 63 will carry the same reference characters as those for the yoke 62 but for the addition of a prime symbol ("") to differentiate the features of the yoke 62 from the features of the yoke 62. The yoke 62 has a Y-shaped body 74, an axle 75 parallel to the axis A extending on either side of the body 74, and two wheels 80 and 81 spaced apart from the axle 75, and mounted for rotation to the body 74 about axes also parallel to the axis A. The yoke 62 is coupled to the chassis 22 at the hole 50 for pivotal movement about the axle 75 in the hole 50. The axle 75 extends through the hole 50 and projects outward from the hole 50 beyond the side 52. The axle 75 has an open end 76 extending coaxially into the axle 75 so as to be available to receive and be coupled to the arm 23. Similarly, the yoke 63 includes body 74', axle 75', and wheels 80' and 81'. The yoke 63 is coupled to the chassis 22 at the hole 51 for pivotal movement about the axle 75' in the hole 51. The axle 75' extends through the hole 51 and projects outward from the hole 51 beyond the side 53. The axle 75' has an open end 76' extending coaxially into the axle 75' so as to be available to receive and be coupled to the arm 24. The yokes 62 and 63, carried in the holes 50 and 51 in the chassis 22, are disposed within the chamber 40 and are directed toward each other so that wheels 80 and 80' are opposed from each other and wheels 81 and 81' are opposed from each other. The impeller 61 is coupled to the yokes 62 and 63, with hub 72 carried between wheels 80 and 81, and hub 73 carried between wheels 80' and 81'. In this way, water that is drawn through the hose coupled to the outlet 41 is pulled into the pool cleaner 20 and into the chamber 40, past the impeller 61, causing the impeller 61 to rotate about the axis A. The hubs 72 and 73, which are offset from the axis A, cyclically pivot or rock in response to rotation of the impeller 61 and in interaction with the wheels 80 and 81, and the wheels 80' and 81', respectively, causing the yokes 62 and 63 to oscillate with respect to the holes 50 and 51.

With reference still to FIG. 3, the arms 23 and 24 are coupled to the yokes 62 and 63, respectively, at the holes 50 and 51 in the sides 52 and 53 of the chassis 22. The arms 23 and 24 are identical, and as such, reference will be made to only the arm 23 with the understanding that the discussion applies equally to the arm 24, and the features of the arm 24 will carry the same reference characters as those for the arm 23 but for the addition of a prime symbol ("") to differentiate the features of the arm 24 from the features of the arm 23. Because of the orientation of the view in FIG. 3, it may be clearer to refer to some features of the arm 24, on which some features can be seen more clearly.

The arm 23 has an elongate body 90 with a front 82 and opposed back 83, an inner side 84 and opposed outer side 85, and a top 86 and opposed bottom 87. An axle 91 located in a generally intermediate location on the inner side 84 of the body 90 with respect to the front 82, rear 83, top 86, and bottom 87 extends away from the body 90 toward the chassis 22. The axle 91 has an outer diameter equal to the inner diameter of the open end 76 of the axle 75 on the yoke 62, and the axle 91 is fit into and encircled by the open end 76 in a press-fit engagement so as to couple the arm 23 to the drive assembly 60 to impart oscillatory movement to the arm 23 in response to rotation of the impeller 61 as water is drawn through the pool cleaner 20.

The arm 23 also carries two hooks 92 and 93 on the outer side 85 of the body 90 between the front 82 and rear 83 of the arm 23 proximate to the bottom 87 of the arm 23. The hooks 92 and 93 are upwardly-directed elbow members formed with enlarged distal heads 92*a* and 93*a*.

Figure 8A:
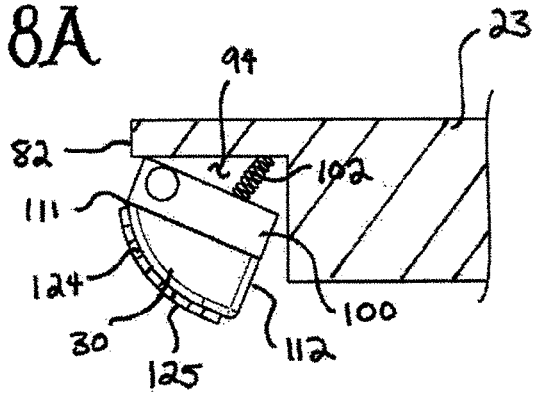
FIGS. 8A, 8B, and 8C are section views of one of the arms and one of the shoes of FIG. 1 taken along the line 8-8 in FIG. 1.

With brief reference to FIGS. 2 and 8A, the arm 23 has a cavity 94 disposed at the front 82 and a cavity 95 disposed at the rear 83. Feet 100 and 101 are mounted on springs 102 and 103 within the cavities 94 and 95, respectively. The feet 100 and 101 are both directed to the front 82 of the arm, with the springs 102 and 103 biasing the feet 100 and 101, respectively, toward the front 82 and outwardly away from the bottom 87 of the arm 23. The feet 100 and 101 are formed with bores for securely engaging with the shoes 30 and 32 applied to the feet 100 and 101.

As mentioned above, the arm 24 is identical to the arm 23, and, as such, includes a body 90', a front 82', a back 83', an inner side 84', and outer side 84', a top 85', a bottom 86', an axle 91', hooks 92' and 93', cavities 94' and 95', feet 100' and 101', and springs 102' and 103'. The arms 23 and 24 are constructed from a material or combination of materials having hard, durable, rigid, and inert material characteristics.

The feet 100 and 101 carry the shoes 30 and 32. The shoe 30 will now be discussed with reference to FIGS. 4A-4D. The shoes 30 and 32 are identical and, as such, reference will be made to only the shoe 30 with the understanding that the discussion applies equally to the shoe 32, and the features of the shoe 32 will carry the same reference characters as those for the shoe 30 but for the addition of a prime symbol ("") to differentiate the features of the shoe 32 from the features of the shoe 30. The shoe 30 has a generally wedge-shaped body 110 having a front 111 and opposed back 112, opposed inner and outer sides 113 and 114, and a top 115 and opposed bottom 116. The inner and outer sides 113 and 114 are parallel with respect to each other and are generally perpendicular to the rear 112 and to the top 115. Two cylindrical studs 120 and 121 are formed on the shoe 30 and extend upwardly from the top 115. The studs 120 and 121 engage with the bores in the foot 100 to couple and hold the shoe 30 onto the foot 100. The studs 120 and 121 are each formed with a circumferential rib 122 to provide an interference fit in the bores in the foot 100. The body 110 of the shoe 30 has a gradient thickness B between the top 115 and the bottom 116 that varies from the front 111 to the rear 112. Proximate to the front 111, the top and bottom 115 and 116 meet at an edge 123, and the thickness B is zero. Proximate to the rear 112, the top and bottom 115 and 116 are apart, and the thickness B is greater, such as approximately 22 millimeters.

Figure 4A:
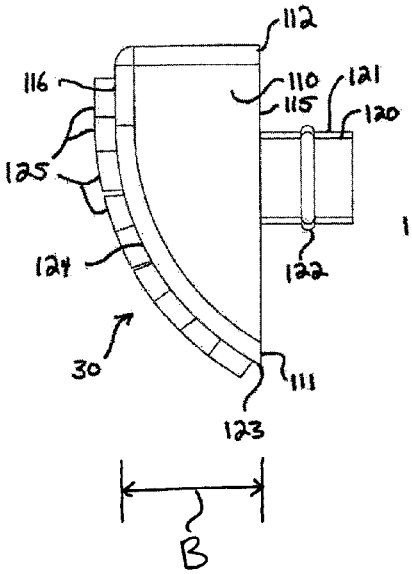
FIGS. 4A-4D are side, top, front, and bottom views of one of the shoes of FIG. 1.
Figure 4B:
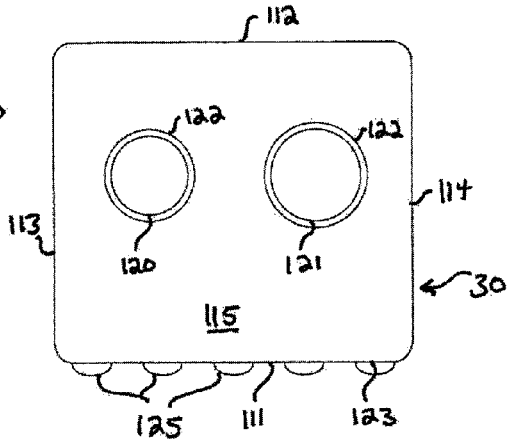
Figure 4C:
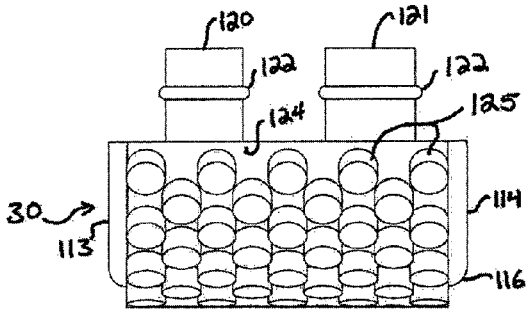
Figure 4D:
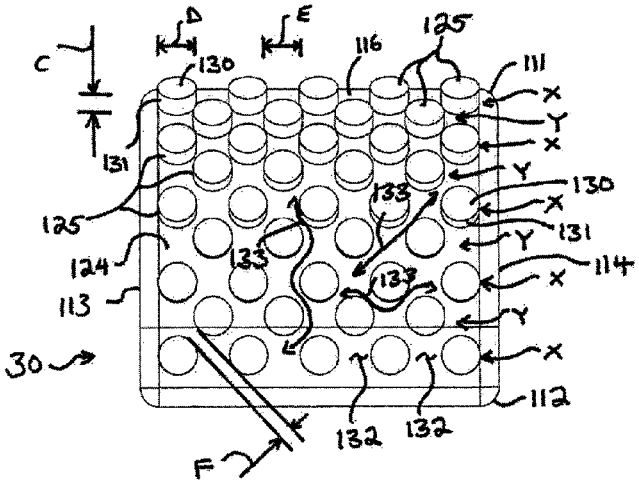

Extending along the bottom 116 of the shoe 30 between the front 111 and the rear 112 is an underside 124 of the shoe 30. The underside 124 is a continuous outer surface of the body 110 of the shoe 30, is arcuate, and has a convex shape. The underside 124 is formed with a plurality of identical nubs 125, and reference will be made to a single nub 125. The nub 125 is a cylindrical projection formed integrally on and extending upwardly from the underside 124 of the shoe 30. Although described herein as cylindrical, other embodiments of the nub 125 are formed in other shapes, such as prismatic and conical. The nub 125 has a circular top 130 and a continuous sidewall 131 extending from the underside 124 of the shoe 30 to the top 130 of the nub 125. The top 130 defines a free end of the nub 125. The nub 125 has a height C from the underside 124 to the top 130, and a diameter D across the top 130, as seen in FIG. 4D. The height C is preferably less than the diameter D, so as to limit the amount of flexing of the nub 125. One having reasonable skill in the art will appreciate that, in some embodiments of the shoe 30, the height C is greater than the diameter D so that the nub 125 extends further through the material 171 collected on the pool surface 34. Each nub 125 across the underside 124 has the same height C so that the nubs 125 are coextensive and terminate at an identical distance apart from the underside 124 of the shoe 30.

The nubs 125 are evenly distributed across the underside 124 of the shoe 30 between the front 111 and back 112 and between the inner side 113 and outer side 114, and are organized in a staggered arrangement of offset rows. The rows are referenced in FIG. 4D as X rows and Y rows. Each X and Y row includes nubs 125 spaced apart from each other by gaps 132. All of the nubs 125 across the underside 124 are spaced apart from each other by the gaps 132. A X row of nubs 125 includes five nubs 125 and four gaps 132 between the nubs 125, and a Y row of nubs 125 includes four nubs 125 and five gaps 132. The nubs 125 in an X row are proximate to the gaps 132 in a Y row, and the nubs 125 in a Y row are proximate to the gaps 132 in a X row. Each nub 125 in a X row is spaced apart from a proximate nub 125 in the X row by a distance E which is equal to the diameter D of the nubs 125. Similarly, each nub 125 in a Y row is spaced apart from a proximate nub 125 in the Y row by the distance E. Each nub 125 in a X row is spaced apart from a proximate nub 125 in a Y row by a distance F, which is less the distance E. The gaps 132 separate the nubs 125, and the gaps 132 cooperate to define passageways 133 between the nubs 125. The passageways 133 extend among the nubs 125 from the inner side 113 to the outer side 114 and from the front 111 to the back 112. The passageways 133 are channels available to receive water and material 171 displaced by the nubs 125 and allow the flow of water and material 171 across the underside 124 while the shoe 30 is in contact with the pool surface.

As mentioned above, the shoe 32 is identical to the shoe 30, and, as such, includes a body 110', a front 111', back 112', inner side 113' and outer side 114', top 115', bottom 116', studs 120' and 121', rib 122', underside 124', and nubs 125' having tops 130' and sidewalls 131'. The shoes 31 and 33 are identical to the shoes 30 and 32. The shoes 30, 31, 32, and 33 are each formed of a material or composition of materials having durable, rugged, adhesive material characteristics, such as cork, plastic, or the like.

With reference back to FIG. 3, the hooks 92 and 93 carry the wings 25 and 26. The wings 25 and 26 are identical and, as such, reference will be made to only the wing 25 with the understanding that the discussion applies equally to the wing 26, and the features of the wing 26 will carry the same reference characters as those for the wing 25 but for the addition of a prime symbol ("") to differentiate the features of the wing 26 from the features of the wing 25. The wing 25 has an airfoil-shaped body having a top 140 and opposed bottom 141, an inner side 142 and opposed outer side 143, a front 144 and an opposed back 145. With reference now to the detailed illustrations in FIGS. 5A-5D, the wing 25 has an underside 150 formed along the bottom 141 of the wing 25. The inner and outer sides 142 and 143 incline obliquely into the wing 25 toward the top 140, the front and rear 144 and 145 incline obliquely into the wing 25 toward the top 140, and the top 140 is generally parallel with respect to the bottom 141, so that the underside 150 is concave. The underside 150 of the wing 25 is a continuous surface of the wing 25 and terminates along the bottom 141 at a lower edge 151 of the wing extending around the bottom 141 along the front 144, rear 145, and outer side 143 of the wing 25.

The underside 150 of the wing 25 carries a plurality of bristles 152. The bristles 152 are fibrous, flexible, resilient projections extending from the underside 150 of the wing 25 beyond the lower edge 151. In the embodiment illustrated in FIGS. 5A-5D, the bristles 152 are arranged in tightly-bunched clusters or groups 153, with each group 153 extending from a conical mount 154 formed integrally to the underside of the wing 25. One having skill in the art will appreciate that in other embodiments of the wing 25, the bristles 152 are evenly distributed across the underside 150 of the wing and not arranged in groups 152 so as to define a continuous brushing surface. Moreover, the bristles 152 may be replaced by other projections, such as downwardly-extending rubber fingers and the like.

Each bristle 152 has a free end 155 and an opposed fixed end 156 secured in the mount 154. The length of the bristle 152 between the free end 155 and the fixed 156 varies for each bristle 152. Each free end 155 terminates at a different distance from the underside 150 of the wing 25 so that each free end 155 terminates coextensively with respect to the lower edge 151. Each free end 155 terminates along a common plane identified with the reference character G in FIGS. 5C and 5D (and shown along an edge of the plane G), that is parallel to and spaced apart from the lower edge 151.

As shown in FIG. 5A, the groups 153 of bristles 152 are evenly distributed across the underside 150 of the wing 25 between the front 144 and the back 145 and between the inner side 142 and the outer side 143, and are organized in rows and columns. Each group 153 of bristles 152 is spaced apart from other groups 153 of bristles 152 by gaps 160, such that each row and column is spaced apart from the respective other rows and columns. The gaps 160 cooperate to define passageways 161 between the groups 153 of bristles 152 extending from the inner side 142 to the outer side 143 and from the front 144 to the back 145. The passageways 161 are channels available to receive water and material 171 displaced by the groups 153 of bristles 152 and allow the flow of water and material 171 across the underside 150 while the groups 153 of bristles 152 are in contact with the pool surface 34.

Figure 6A:
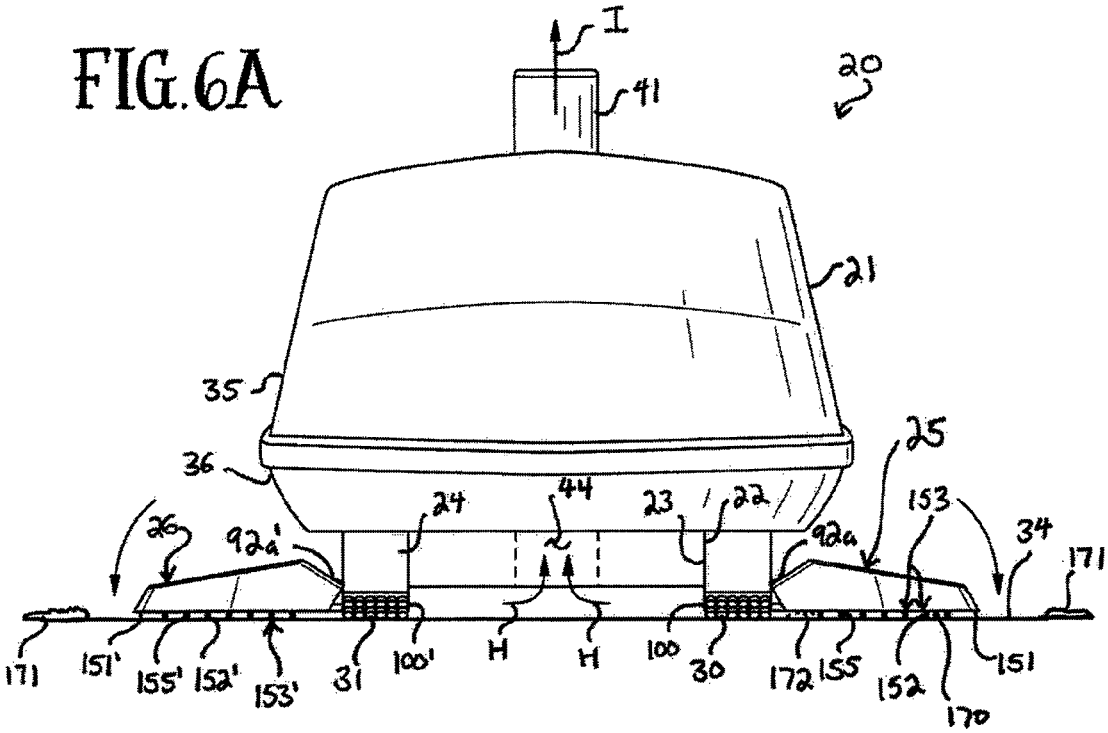
FIGS. 6A and 6B are front elevation views of the pool cleaner of FIG. 1 illustrating the wings in a lowered position and a raised position, respectively.
Figure 6B:
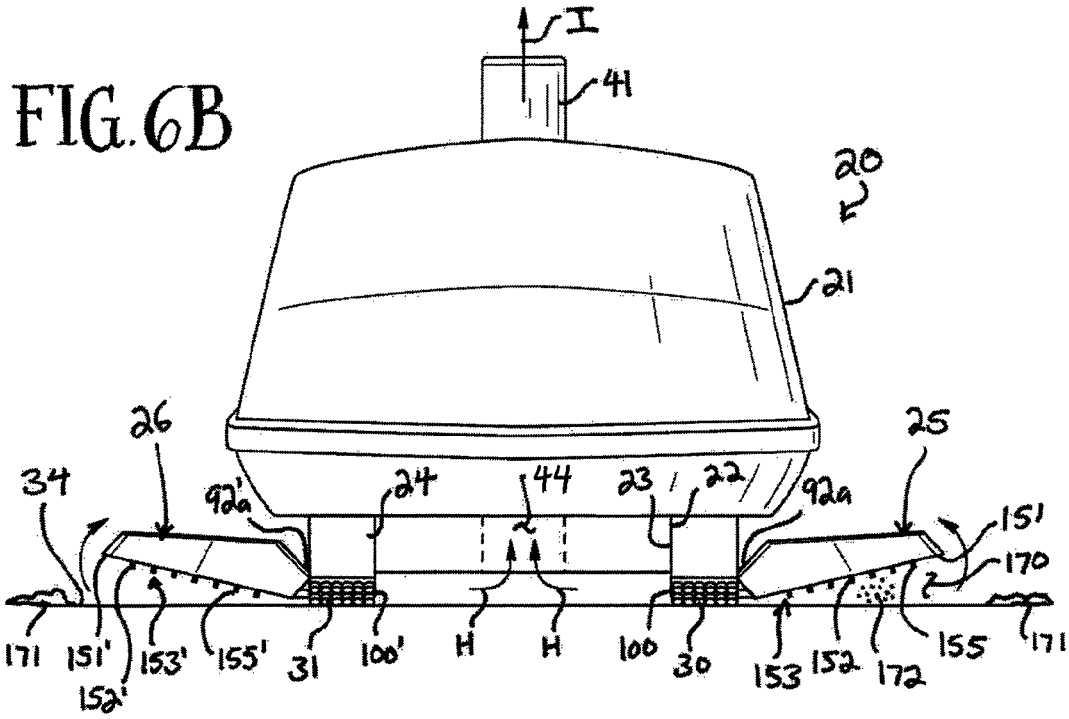

The inner side 142 of the wing 25 is formed with two spaced-apart holes 162 and 163 formed at a generally intermediate location on the inner side 142 with respect to the front and back 144 and 145 and with respect to the top and bottom 140 and 141. The wing 25 is carried for flapping movement on the hooks 92 and 93 on the arm 23 in response to the oscillatory movement of the arm 23 as water is drawn through the pool cleaner 20 to rotate the impeller 61. The amplitude of the flapping movement is affected by the amount of suction produced by the pool pump at the pool cleaner 20. A high amount of suction causes the wing 25 to flap with high amplitude, as illustrated in FIGS. 6A and 6B. A low amount of suction causes the wing 25 to flap with low amplitude, such that the flapping becomes vibration of the wing 20 or is not be visible at all. In low-amplitude flapping, the bristles 152 flex and relax in a brushing motion as the bristles 152 are reciprocally vibrated against the pool surface 34. Nevertheless, this movement is referred to as flapping movement for consistency of description. For purposes of clarity and ease of description, this disclosure refers to and illustrates high-amplitude flapping. The holes 162 and 163 define a loose engagement fitting on the hooks 92 and 93 allowing the holes 162 and 163 to slide along the hooks 92 and 93 with a substantial play along the length of the hooks 92 and 93. The holes 162 and 163 are initially deformed and pressed over the enlarged distal heads 92*a* and 93*a* of the hooks 92 and 93, so as to prevent the separation of the wing 25 from the hooks 92 and 93 during operation.

As mentioned above, the wing 26 is identical to the wing 25, and, as such, includes a top 140', 141', inner side 142', outer side 143', front 144', back 145', underside 150', lower edge 151', and groups 153' of bristles 152' formed in mounts 154' and having free ends 155', fixed ends 156', gaps 160', and passageways 161'. The wings 25 and 26 are constructed from a material or combination of materials having rigid material characteristics such plastic, and the bristles 125 and 125' are constructed from a material or combination of materials having flexible, resilient, and durable material characteristics, such as polypropylene, polyamide nylon, or the like.

With reference to FIGS. 6A and 6B, during operation of the cleaner 20, the cleaner 20 is useful for cleaning the material 171, such as dirt, sediment, algae, and the like, from a pool surface 34 of a swimming pool structure. FIGS. 6A and 6B illustrate the cleaner 20 as it would appear cleaning the pool surface 34. Water is drawn into the inlet 44 in the cleaner 20 along arrowed lines H, through the housing 21 of the cleaner 20 containing the drive assembly 60 (as shown in FIG. 3), and out the outlet 41 through a hose (not shown) coupled to the outlet 41 in response to an operating pump disposed at the other end of the hose drawing water through the hose. With brief reference to FIG. 3, as the water is drawn through the chamber 40, water impacts the vanes 65 of the impeller 61, causing the impeller 61 to rotate. The impeller 61 rotates, imparting pivotal movement to the yokes 62 and 63 about axles 75 and 75', which causes the arms 23 and 24 to oscillate.

Returning to FIGS. 6A and 6B, the arms 23 and 24 each oscillate between a first position and a second position. Throughout movement between the first and second positions of the arms 23 and 24, the shoes 30, 31, 32, and 33 and the wings 25 and 26 are the points of contact of the pool cleaner 20 with the pool surface 34. With reference now to just the arm 23, with the understanding that the discussion applies equally to the arm 24, in the first position of the arm 23, the front 82 of the arm 23 is raised away from the pool surface 34 and the back 83 of the arm 23 is toward the pool surface 34. The shoes 30 and 32 remain in contact with the pool surface 34 in and between the first and second positions, and are advanced forward along the pool surface 34 in response to the oscillatory movement between the first and second positions so as to move the pool cleaner 20 forward. The wing 25 is coupled to the arm 23 for flapping movement in response to the oscillatory movement of the arm 23. The hook 92 is located toward the front 82 of the arm 23 opposite the arm 23 from the axle 75, so that the hole 162 proximate to the front 144 of the wing 25 is secured on the hook 92. The hook 93 is located toward the back 83 of the arm, so that the hole 163 proximate to the back 145 of the wing 25 is secured on the hook 93. In this arrangement, when the arm 23 moves into the first position, the front 82 of the arm 23 moves upward, the front 144 of the wing 25 moves upward, the back 83 of the arm 23 moves downward, and the back 145 of the wing 25 moves downward. After the arm 23 reaches the first position and moves toward the second position, the wing 25 moves into a raised position of the wing 25 (shown in FIG. 6B) in which the lower edge 151 of the wing 25 is away from the pool surface 34. When the arm 23 moves into the second position, the front 82 of the arm 23 moves downward, the front 144 of the wing 25 moves downward, the back 83 of the arm 23 moves upward, and the back 145 of the wing 25 moves upward. After the arm 23 reaches the second position and moves toward the first position, the wing 25 moves into a lowered position of the wing 25 (shown in FIG. 6A) in which the lower edge 151 of the wing 25 is toward the pool surface 34.

In this way, as the arm 23 oscillates between the first and second positions, and the front 144 and back 145 of the wing 25 oscillate up and down, causing the wing 25 to flap between the raised and lowered positions with a very slight pitch of a few degrees. The play in the engagement between the hook 92 and 93 and the holes 162 and 163, respectively, allows the movement of the front 144 of the wing 25 to be only slightly offset from the movement of the back 145 of the wing 25 and is not directly opposed. In other words, the back 145 lags slightly behind the front 144 during movement of the arm 23 between the first and second positions, so that the wing 25 flaps substantially parallel to the pool surface 34 between the raised and lowered positions of the wing 25.

As the pool cleaner 20 moves forward, the airfoil shape of the wing 25 draws water under the wing 25 as the wing 25 oscillates. As the front 144 of the wing 25 rises, water moves under the lower edge 151 along the front 144 and is held between the underside 150 of the wing 25 and the pool surface 151. A volume of water 170 is trapped between the underside 150 of the wing 25 and the pool surface 34, as shown in FIGS. 6A and 6B. When the front 144 of the wing 25 lowers as the wing 25 moves into the lowered position, the groups 153 of bristles 152 contact the pool surface 34 through the material 171. The groups 153 of bristles 152 proximate to the front 144 of the wing 25 contact the pool surface 34 initially, followed quickly by the remaining groups 153 of bristles 152.

The free ends 155 of the bristles 153 in each group 153 initially penetrate the material 171 and then contact the pool surface 34. As the distal ends 155 of the bristles 152 in the groups 153 penetrate the material 171, the material 171 begins to lift off the pool surface 34 and become suspended as suspended material 172 (as seen more clearly in FIGS. 7A and 7B). The bristles 152 are configured to extend through the material 171, and the contact of the bristles 152 against the pool surface 34 causes the bristles 152 to flex, brushing and disturbing the material 171 collected on the pool surface 34, such as dirt, sediment, algae, and the like, causing more of the material 171 to be suspended in the volume of water 170 and in the gaps 160 and passageways 133. The bristles 153 extend past the lower edge 151 into the material 171 to brush and disturb the material 171 from the pool surface 34, and one having reasonable skill in the art will understand that longer bristles 153 extend further past the lower edge 151 to penetrate deeper collections of material 171 on the pool surface 34.

Figure 7A:
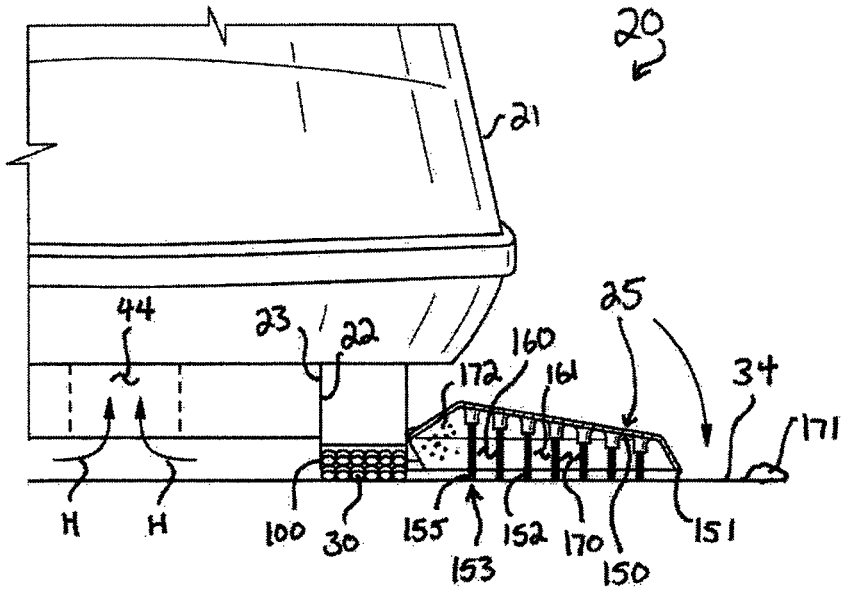
FIGS. 7A and 7B are enlarged front section views of the pool cleaner of FIG. 1 taken along the line 7-7 in FIG. 1 showing the wings in the lowered and raised positions, respectively.

The suspended material 172 is contained with the volume of water 170 bound by the underside 150 of the wing 25 and the pool surface 34 when the wing 25 is in the lowered position, as shown in FIG. 7A. Water continues to be drawn into the inlet 44 through the housing 21 during flapping movement of the wing 25. When the wing 25 is in the lowered position, the water drawn into the inlet 44 moves from the gap between the lower edge 151 of the wing 25 and the pool surface 34 and from between the chassis 20 and the pool surface 34. Little water moves below the wing 25 into the inlet 44 compared to the amount of water which moves into the inlet 44 from between the chassis 22 and the pool surface 34, so that the movement of water between the underside 150 of the wing 25 and the pool surface 34 is contained with the volume of water 170 when the wing 25 is in the lowered position. In this way, the suspended material 172 remains suspended in the volume of water 170 and in the gaps 160 and passageways 161 between the groups 153 of bristles 152.

Figure 7B:
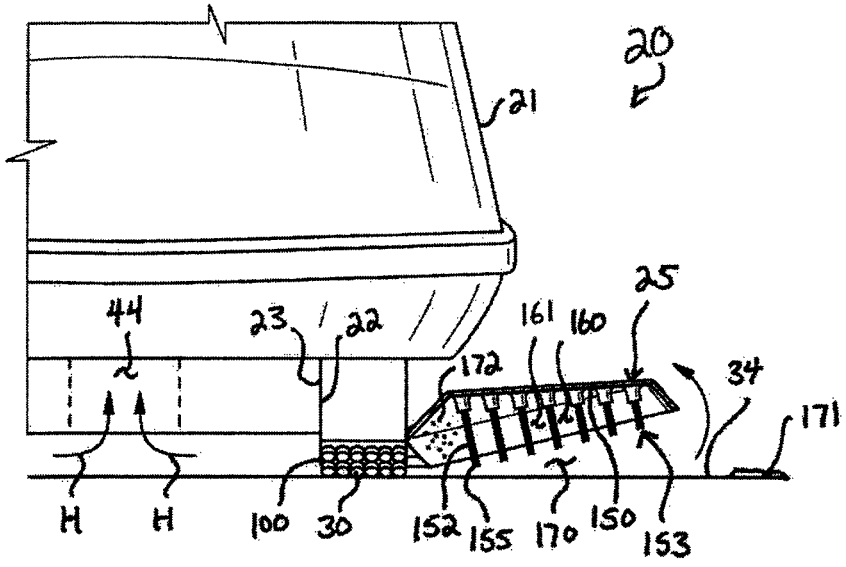

As the arm 23 moves from the first position to the second position, the wing 25 moves into the raised position thereof, exposing the volume of water 170, as shown in FIG. 7B. The volume of water 170 is now available to be drawn into the inlet 44, and with it, the suspended material 172 in the volume of water 170 is also available to be drawn into the inlet 44. Moreover, the suspended material 172 in the volume of water 170 among the groups 153 of bristles 152 is drawn through the gaps 160 and passageways 161 between the groups 153 of bristles 152 into the inlet 44. In this way, by contacting, disturbing, brushing, suspending, and vacuuming the material 171, the pool cleaner 20 cleans the portion of the pool surface 34 under the wing 25. As the arm 23 moves from the first position to the second position, the pool cleaner 20 advances forward, and the wing 25 moves into the lowered position over an as-yet uncleaned portion of the pool surface 34. This cycle repeats continuously while the pool cleaner 20 operates. With repeated oscillation, the bristles 152 contact the pool surface 34 and protect the underside 150 and lower edge 151 of the wing 25 from abrasion against the pool surface 34, so as to prevent the underside 150 and lower edge 151 of the wing 25 from wearing down. The bristles 152 space the wing 25 away from the pool surface 34 during operation and non-operation so as to prevent damage to the underside 150 and lower edge 151 of the wing 25.

Figure 8B:
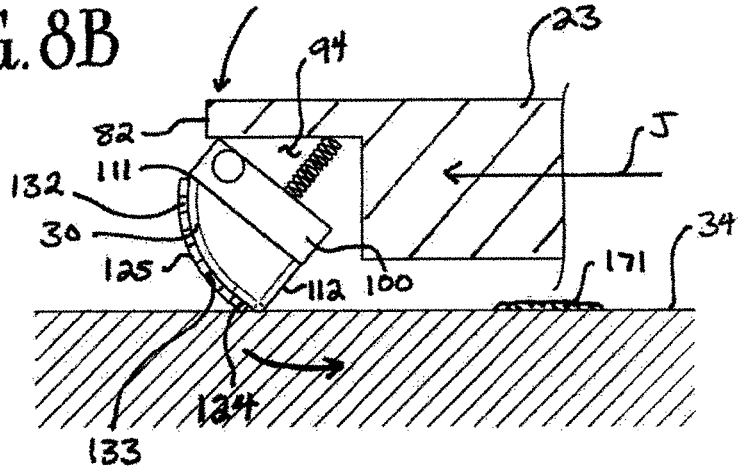
Figure 8C:
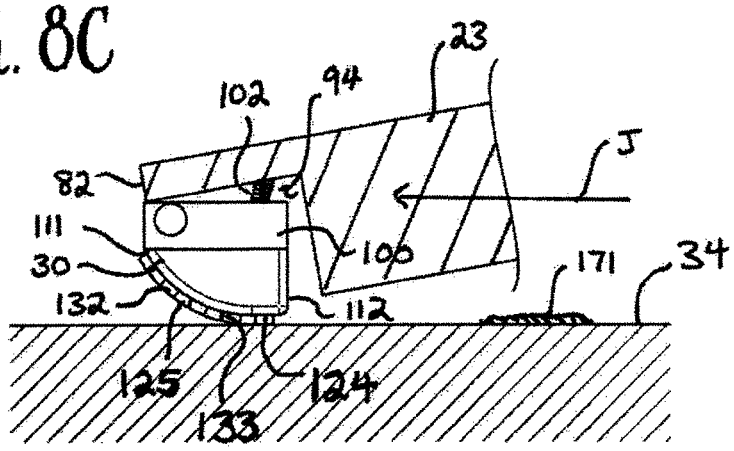

The shoes 30, 31, 32, and 33 are useful for providing enhanced traction with the pool surface 34 and for providing enhanced forward movement of the pool cleaner 20 with an alternating grip-release engagement with the pool surface 34. The shoes 30, 31, 32, and 33 are continuous points of contact of the pool cleaner 20 with the pool surface 20, and the shoes 30, 31, 32, and 33 are the site of the application of the propelling force on the pool surface 34 imparted by the drive assembly 60 to move the pool cleaner 20 forward. With reference now to FIGS. 8B and 8C, which are detailed section views of the front 82 of the arm 23, the foot 100, and the shoe 30, the pool cleaner 20 moves forward during operation along a direction generally indicated by arrowed line J. As the pool cleaner 20 moves forward, and as described above, the arm 23 oscillates between a first position (shown in FIG. 8B) and a second position (shown in FIG. 8C). In the first and second positions of the arm 23, the nubs 125 on the shoe 30 extend through the material 171 collected on the pool surface 34 to contact the pool surface 34 so as to provide the foot 100 with direct contact with the pool surface 34 and provide enhanced traction between the foot 100 and the pool surface 34. The underside 124 of the shoe 30 is spaced apart from the pool surface 34.

In the first position of the arm 23, shown in FIG. 8B, the front 82 of the arm 23 is pivoted away from the pool surface 34, and the spring 102 urges the foot 100 and shoe 30 downward, pivoting the foot 100 outward about the front 82 of the arm 23, so as to place the nubs 125 at the back 112 of the shoe 30 in contact with the pool surface. The spring 102 is extended, exerting a force on the shoe 30 on the pool surface 34 along the length of the spring 102, and the front 82 of the arm 23 is away from the pool surface 34, so that the normal force on the pool surface 34 exerted by the shoe 30 is low compared to that exerted in the second position of the arm 23, and the shoe 30 is placed in a release condition in which the nubs 125 are in light contact with the pool surface 34 and are capable of rolling across the pool surface 34 without flexing under the compressive force exerted by the spring 102.

As the arm 23 moves toward the second position, shown in FIG. 8C, the front 82 of the arm 23 moves downward, rolling the shoe 30 forward on the nubs 125 and moving the pool cleaner 20 incrementally forward along line J by a distance equal to the length of the underside 124 of the shoe 30. As the shoe 30 rolls, the shoe 30 increases grip with the pool surface 34 and advances along the pool surface 34, moving the pool cleaner 70 forward. In the second position of the arm 23, the nubs 125 extending from the underside 124 behind the front 111 of the shoe 30 are in contact with the pool surface 34. The spring 102 is compressed, biasing the shoe 30 downward in a direction parallel to the compressed spring 102, so that the nubs 125 are compressed against the pool surface 34, increasing the normal force against the pool surface 34 and thus the frictional force between the nubs 125 and the pool surface 34, providing enhanced traction. Moreover, the nubs 125 increase the coefficient of friction of the shoe 30 beyond that of the underside 124 of the shoe 30 alone, so that the shoe 30 does not slip on the pool surface 34. In this way, the shoe 20 grips the pool surface 34 to provide the pool cleaner 20 engagement and traction with respect to the pool surface 34 so as to move the pool cleaner 20 forward.

The arm 23 then moves back to the first position shown in FIG. 8B. As the arm 23 moves back to the first position, the shoe 30 releases the grip on the pool surface 34. The front 82 of the arm 23 pivots away from the pool surface 34, and the spring 102 urges the foot 100 and shoe 30 downward, pivoting the foot 100 about the front 82 of the arm 23, so as to place the nubs 125 at the back 112 of the shoe 30 in contact with the pool surface. This cycle repeats continuously while the pool cleaner 20 operates. With repeated oscillation of the arms 23 and 24, the nubs 125 on the shoe 30 contact the pool surface 34 and protect the underside 124 of the shoe 30 from abrasion against the pool surface 34, so as to prevent the shoe 30 from wearing down. The nubs 125 space the shoe 30 away from the pool surface 34 during operation and non-operation so as to prevent damage to the underside 124 of the shoe 30.

Throughout movement of the arm 23 between the first and second positions, the shoe 30 is maintained in contact with the pool surface 34. The nubs 125 extending through the material 171 collected on the pool surface 34 displace the material 171 into the gaps 132 and passageways 133 between the nubs 125, forcing the material 171 to move out from under the nubs 125 so that the nubs 125 make clear, direct contact with the pool surface 34. By displacing the material 171 into the gaps 132 and passageways 133 and underneath the underside 124 of the shoe 30, the material 171 is left on the pool surface 34 and made available to be suspended by the wing 25 later. In this way, the shoe 30 does not disturb the material 171 but instead leaves the material 171 on the pool surface 34 where the wing 25 will suspend it for being drawn into the inlet 44.

The present invention is described above with reference to a preferred embodiment. However, those skilled in the art will recognize that changes and modifications may be made in the described embodiment without departing from the nature and scope of the present invention. Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A pool cleaner apparatus for cleaning material collected on a pool surface, the apparatus comprising:

a chassis;

an arm mounted to the chassis for oscillatory movement of the arm;

a wing having a lower edge, the wing mounted to the arm for flapping movement in response to oscillatory movement of the arm; and projections carried on an underside of the wing configured to disturb the material from the pool surface.

2. The apparatus of claim 1, wherein the projections extend from the underside of the wing to beyond the lower edge of the wing.

3. The apparatus of claim 1, wherein the projections are bristles.

4. The apparatus of claim 1, wherein the projections contact the material collected on the pool surface during flapping movement of the wing, suspending the material between the underside of the wing and the pool surface.

5. The apparatus of claim 1, wherein the projections are arranged in clusters.

6. The apparatus of claim 1, further comprising passageways formed between the projections for the movement of water around the projections.

7. The apparatus of claim 1, wherein the projections each have a free end terminating along a common plane spaced apart from the lower edge.

8. The apparatus of claim 7, wherein the plane is parallel to the lower edge of the wing.

9. A pool cleaner apparatus for cleaning material collected on a pool surface, the apparatus comprising:

a housing having an inlet for drawing water into the housing and an outlet for expelling water out of the housing;

a wing mounted to the housing for flapping movement in response to water being drawn through the housing, the wing including a lower edge and projections extending outward beyond the lower edge from an underside of the wing;

the wing moves between a raised position away from the pool surface and a lowered position proximate to the pool surface; and in the lowered position of the wing, the lower edge is spaced apart from the pool surface and the projections are in contact with the pool surface so as to disturb the material from the pool surface and suspend the material in the water between the underside of the wing and the pool surface.

10. The apparatus of claim 9, wherein in the lowered position of the wing, the wing cooperates with the pool surface to bound a volume of water in which the material disturbed by the projections is suspended; and in the raised position of the wing, the volume of water and the material suspended in the volume of water is available to be drawn into the inlet in the housing.

11. The apparatus of claim 9, wherein the projections are bristles.

12. The apparatus of claim 9, wherein the projections contact the material collected on the pool surface during flapping movement of the wing, suspending the material between the underside of the wing and the pool surface.

13. The apparatus of claim 9, wherein the projections each have a free end terminating along a common plane spaced apart from the lower edge.

14. The apparatus of claim 13, wherein the plane is parallel to the lower edge of the wing.

* * * * *